US008740675B2

(12) United States Patent
Wu et al.

(10) Patent No.: US 8,740,675 B2
(45) Date of Patent: Jun. 3, 2014

(54) METHOD OF MAKING A GRINDING DISK AND A GRINDING DISK

(75) Inventors: Yu-Lung Wu, Taiwan (CN); Yang-Wen Lee, Bade (CN); Ming-Tien Chang, Xinbei (TW)

(73) Assignee: 3M Innovative Properties Company, St. Paul, MN (US)

( * ) Notice: Subject to any disclaimer, the term of this patent is extended or adjusted under 35 U.S.C. 154(b) by 214 days.

(21) Appl. No.: 13/509,340

(22) PCT Filed: Dec. 20, 2010

(86) PCT No.: PCT/US2010/061210
§ 371 (c)(1),
(2), (4) Date: May 11, 2012

(87) PCT Pub. No.: WO2011/079059
PCT Pub. Date: Jun. 30, 2011

(65) Prior Publication Data

US 2012/0231712 A1 Sep. 13, 2012

(30) Foreign Application Priority Data

Dec. 25, 2009 (CN) ..... 2009 1 0259760

(51) Int. Cl.

| | |
|---|---|
| ***B24D 18/00*** | (2006.01) |
| ***B24D 5/16*** | (2006.01) |
| ***B24D 7/16*** | (2006.01) |
| ***B24D 5/02*** | (2006.01) |
| ***B24D 7/02*** | (2006.01) |

(52) U.S. Cl.
CPC *B24D 18/00* (2013.01); *B24D 5/16* (2013.01); *B24D 7/16* (2013.01); *B24D 5/02* (2013.01); *B24D 7/02* (2013.01)
USPC ..... 451/548; 451/490; 451/508; 451/509

(58) Field of Classification Search
CPC ..... B24D 11/001; B24D 18/0009; B24D 18/0054; B24D 9/085; B24D 7/00; B29C 45/14467
USPC ..... 451/490, 508, 509, 548–551; 264/263, 264/273; 51/295
See application file for complete search history.

(56) References Cited

U.S. PATENT DOCUMENTS 1,209,831 A 12/1916 Gardner
1,910,444 A 5/1933 Nicholson
(Continued)

FOREIGN PATENT DOCUMENTS

DE 10 516 83 2/1959
DE 330 12 10 C2 3/1987
(Continued)

OTHER PUBLICATIONS

Colleselli, et a; "Schleifscheiben Und Schleifkoerper" Duroplaste, Kunststoff Handbuch, Munchen, Hanser Verlang, De. 1988, pp. 894, 896-897, 901, vol. 10.

(Continued)

*Primary Examiner* — George Nguyen
(74) *Attorney, Agent, or Firm* — Scott A. Baum

(57) ABSTRACT

The invention relates to a method of making a grinding disk, comprising the steps of: providing a cap; providing an abrasive part; placing the cap on the abrasive part to form an assembly; holding the assembly and injecting a molding material into a space between the cap and the abrasive part and into the abrasive part to bond the cap and the abrasive part. A grinding disk made by the method is also disclosed.

23 Claims, 3 Drawing Sheets

(56) References Cited

U.S. PATENT DOCUMENTS

| | | | | | |
|---|---|---|---|---|---|
| 2,161,725 | A | | 6/1939 | Smith | |
| 2,174,902 | A | * | 10/1939 | Stratford | 451/510 |
| 2,241,433 | A | * | 5/1941 | Walker | 51/297 |
| 2,279,278 | A | * | 4/1942 | Shue | 451/548 |
| 2,353,864 | A | * | 7/1944 | Wooddell | 51/293 |
| 2,378,271 | A | * | 6/1945 | Whelldon, Jr. | 451/548 |
| 2,418,883 | A | * | 4/1947 | Homeyer | 451/548 |
| 2,492,143 | A | * | 12/1949 | Gipple et al. | 451/532 |
| 2,752,634 | A | | 7/1956 | Rengering | |
| 2,958,593 | A | | 11/1960 | Hoover | |
| 3,041,156 | A | | 6/1962 | Rowse | |
| 3,043,063 | A | | 7/1962 | Peterson | |
| 3,362,114 | A | | 1/1968 | Hurst | |
| 3,372,220 | A | * | 3/1968 | Stingley | 264/236 |
| 3,436,874 | A | * | 4/1969 | Betzler | 451/56 |
| 3,500,592 | A | | 3/1970 | Harrist | |
| 3,540,163 | A | * | 11/1970 | Shoemaker | 451/548 |
| 3,576,090 | A | * | 4/1971 | Shoemaker | 451/548 |
| 3,707,059 | A | | 12/1972 | Burtch | |
| 3,800,483 | A | | 4/1974 | Sherman | |
| 3,861,955 | A | | 1/1975 | Lemelson | |
| 3,991,526 | A | | 11/1976 | Frank | |
| 4,054,425 | A | | 10/1977 | Sherman | |
| 4,088,729 | A | | 5/1978 | Sherman | |
| 4,227,350 | A | | 10/1980 | Fitzer | |
| 4,311,489 | A | | 1/1982 | Kressner | |
| 4,314,827 | A | | 2/1982 | Leitheiser | |
| 4,437,271 | A | | 3/1984 | McAvoy | |
| 4,448,590 | A | | 5/1984 | Wray | |
| 4,541,207 | A | * | 9/1985 | Antonson | 451/508 |
| 4,623,364 | A | | 11/1986 | Cottringer | |
| 4,652,275 | A | | 3/1987 | Bloecher | |
| 4,744,802 | A | | 5/1988 | Schwabel | |
| 4,770,671 | A | | 9/1988 | Monroe | |
| 4,774,788 | A | | 10/1988 | Shacham | |
| 4,799,939 | A | | 1/1989 | Bloecher | |
| 4,881,951 | A | | 11/1989 | Wood | |
| 4,941,293 | A | * | 7/1990 | Ekhoff | 451/342 |
| 4,951,341 | A | | 8/1990 | Shears | |
| 5,009,675 | A | | 4/1991 | Kunz | |
| 5,011,508 | A | | 4/1991 | Wald | |
| 5,042,991 | A | | 8/1991 | Kunz | |
| 5,090,968 | A | | 2/1992 | Pellow | |
| 5,201,916 | A | | 4/1993 | Berg | |
| 5,209,760 | A | | 5/1993 | Wiand | |
| 5,213,591 | A | | 5/1993 | Celikkaya | |
| 5,232,470 | A | | 8/1993 | Wiand | |
| 5,273,558 | A | | 12/1993 | Nelson | |
| 5,436,700 | A | | 7/1995 | Kikuchi | |
| 5,443,906 | A | | 8/1995 | Pihl | |
| 5,549,962 | A | | 8/1996 | Holmes | |
| 5,560,070 | A | | 10/1996 | Reaume | |
| 5,573,844 | A | | 11/1996 | Donovan | |
| 5,593,467 | A | | 1/1997 | Monroe | |
| 5,607,488 | A | | 3/1997 | Wiand | |
| 5,632,790 | A | | 5/1997 | Wiand | |
| 5,645,618 | A | | 7/1997 | Monroe | |
| 5,651,801 | A | | 7/1997 | Monroe | |
| 5,671,511 | A | | 9/1997 | Hattori | |
| 5,736,081 | A | | 4/1998 | Yamakawa | |
| 5,849,646 | A | | 12/1998 | Stout | |
| 5,876,470 | A | | 3/1999 | Abrahamson | |
| 5,895,612 | A | | 4/1999 | Warner | |
| 5,928,070 | A | | 7/1999 | Lux | |
| 5,975,988 | A | | 11/1999 | Christianson | |
| 5,996,167 | A | | 12/1999 | Close | |
| 6,001,202 | A | | 12/1999 | Penttila | |
| 6,004,363 | A | | 12/1999 | Pisacane | |
| 6,083,445 | A | * | 7/2000 | Warner et al. | 264/237 |
| 6,110,027 | A | * | 8/2000 | Muller | 451/359 |
| 6,179,887 | B1 | | 1/2001 | Barber, Jr. | |
| 6,261,156 | B1 | * | 7/2001 | Johnson et al. | 451/41 |
| 6,302,930 | B1 | | 10/2001 | Lux | |
| 6,521,004 | B1 | | 2/2003 | Culler | |
| 6,620,214 | B2 | | 9/2003 | McArdle | |
| 6,638,144 | B2 | | 10/2003 | Sventek | |
| 6,679,758 | B2 | | 1/2004 | Bright | |
| 6,786,801 | B2 | | 9/2004 | Mann | |
| 6,811,582 | B1 | | 11/2004 | Wurzer | |
| 6,863,596 | B2 | * | 3/2005 | Fritz et al. | 451/59 |
| 7,121,924 | B2 | | 10/2006 | Fritz | |
| 7,351,133 | B1 | * | 4/2008 | Lemberger et al. | 451/548 |
| 8,113,921 | B2 | * | 2/2012 | Krauss et al. | 451/357 |
| 8,137,423 | B2 | * | 3/2012 | Lise et al. | 51/298 |
| 2001/0011108 | A1 | | 8/2001 | Thurber | |
| 2002/0019199 | A1 | | 2/2002 | Goers | |
| 2002/0095871 | A1 | | 7/2002 | McArdle | |
| 2002/0132572 | A1 | * | 9/2002 | Lageson et al. | 451/526 |
| 2002/0177387 | A1 | | 11/2002 | Keipert | |
| 2003/0113509 | A1 | | 6/2003 | Lugg | |
| 2005/0233678 | A1 | | 10/2005 | Fritz | |
| 2007/0141969 | A1 | * | 6/2007 | Cybulski et al. | 451/509 |
| 2008/0182487 | A1 | * | 7/2008 | Muller et al. | 451/53 |
| 2009/0023366 | A1 | | 1/2009 | Lise | |
| 2009/0209186 | A1 | * | 8/2009 | Krauss et al. | 451/548 |
| 2010/0151778 | A1 | * | 6/2010 | Telischak et al. | 451/549 |
| 2010/0159813 | A1 | * | 6/2010 | Pajovic | 451/548 |
| 2010/0190420 | A1 | | 7/2010 | Yamahara | |
| 2010/0210194 | A1 | * | 8/2010 | Thomaschewski et al. | 451/357 |

FOREIGN PATENT DOCUMENTS

| | | | |
|---|---|---|---|
| DE | 195 01 201 | | 7/1996 |
| DE | 199 51 250 | | 5/2001 |
| DE | 102 10 673 | | 9/2003 |
| EP | 0 451 944 | | 10/1991 |
| EP | 0 551 714 | | 7/1993 |
| EP | 0 554 806 | | 8/1993 |
| EP | 0 790 880 | B1 | 8/1997 |
| EP | 1 010 495 | | 6/2000 |
| EP | 1 018 404 | | 7/2000 |
| EP | 1 666 230 | | 6/2006 |
| EP | 1 795 304 | | 6/2007 |
| FR | 1 178 553 | | 5/1959 |
| FR | 2 388 538 | | 12/1978 |
| FR | 2 776 553 | | 10/1999 |
| GB | 491 658 | | 9/1938 |
| GB | 790 003 | | 1/1958 |
| GB | 1 420 295 | | 1/1976 |
| GB | 2 247 201 | | 2/1992 |
| GB | 2 304 071 | | 3/1997 |
| GB | 2 382 023 | | 5/2003 |
| JP | 58-171263 | | 10/1983 |
| JP | 2007-331058 | | 10/1983 |
| JP | 61-61169 | | 4/1986 |
| JP | H5-229071 | | 9/1993 |
| JP | 08-072171 | | 3/1996 |
| JP | 08-140913 | | 6/1996 |
| JP | 11-320423 | | 11/1999 |
| JP | 2000-006036 | | 11/2000 |
| JP | 2001-025957 | | 1/2001 |
| KR | 10-1994-0023417 | | 11/1994 |
| KR | 10-2002-0095941 | | 12/2002 |
| KR | 2003-28233 | | 4/2003 |
| WO | WO 92/05014 | | 4/1992 |
| WO | WO 96/21058 | | 7/1996 |
| WO | WO 96/33638 | | 10/1996 |
| WO | WO 98/23411 | | 6/1998 |
| WO | WO 02/32832 | A1 | 4/2002 |
| WO | WO 02/33019 | A1 | 4/2002 |
| WO | WO 02/33030 | A1 | 4/2002 |
| WO | WO 02/094506 | A1 | 11/2002 |
| WO | WO 2005/115716 | | 12/2005 |
| WO | WO 2006/023178 | | 3/2006 |

OTHER PUBLICATIONS

"Handbook of Chemistry and Physics", p. F-22 (1975).

Lafferty, Peter, "The Dictionary of Science", p. 386 (1993).

Reese, "Thermoplastic Elastomers. A Comprehensive Review", edited by N.R. Legge, G. Holden and H.E. Schroeder, Hanser Publishers, New York, 1987, pp. 232-243.

(56) References Cited

OTHER PUBLICATIONS

3M "Radial Bristle Discs" URL:http:—multimedia.3m.com-mws-mediawebserver?mswld=66666UuZjcFSLXTt1XMX1XMcEVuQEcuZgVs6EVs6E666666—[retreived on Nov. 10, 2010] XP002608845.

http://www.shop3m.com/61500068178.html?WT.mc_ev=clickthrough&WT.mc_id=3M-com-GoogleOneBox-61500068178, Scotch-Brite TM Clean and Strip Disc D1, 4 in x½ in X¼ in S XCS. (May 18, 2011).

* cited by examiner

METHOD OF MAKING A GRINDING DISK AND A GRINDING DISK

CROSS REFERENCE TO RELATED APPLICATIONS

This application is a national stage filing under 35 U.S.C. 371 of PCT/US2010/61210, filed Dec. 20, 2010, which claims priority to Chinese Patent Application No. 200910259760.3, filed Dec. 25, 2009, the disclosures of which is incorporated by reference in their entirety herein.

FIELD OF THE INVENTION

The present invention relates to a method of making a grinding disk and a grinding disk made using the same, and more particularly to a method of making a grinding disk through injection molding.

DESCRIPTION OF THE PRIOR ART

A grinding disk is a consumable installed on a polishing/grinding tool. Through high speed rotation of the polishing/grinding tool, the periphery of the grinding disk contacts and rubs the surface of a work piece, so as to smooth the surface of the work piece.

A conventional grinding disk includes a cap and an abrasive part. The cap is usually a disk-shaped plastic piece. The abrasive part is a disk of paper, cloth, or fiber glued together, in the center of which a through hole is provided. One end of the cap is inserted in the central hole of the abrasive part, and the cap and the abrasive part are glued together.

However, the grinding disk made in such a gluing mode breaks easily when used in a polishing/grinding tool that rotates at a high speed (for example, 10,000 rpm). In addition, the gluing mode requires a lot of auxiliary tools and the glue takes a long time to solidify. Moreover, as the glue is unevenly distributed, the weight of the grinding disk is also unevenly distributed, thereby causing vibration when the grinding disk rotates.

Therefore, a fast and simple method for making a grinding disk is needed, in which the grinding disk made through the method does not break easily during high speed rotation and the weight of the grinding disk is evenly distributed, so that the vibration during the rotation of the grinding disk is decreased.

SUMMARY OF THE INVENTION

The present invention is directed to a fast and simple method of making a grinding disk, in which a cap and an abrasive part are bonded through injection molding.

The present invention is further directed to a grinding disk which does not break easily during high speed rotation, and has evenly distributed weight so that vibration of the grinding disk is decreased during rotation.

In order to achieve the above objectives, the present invention provides a method of making a grinding disk which includes the following steps. A cap is provided. An abrasive part is provided. The cap is placed on the abrasive part to form an assembly. The assembly is held and a molding material is injected into a space between the cap and the abrasive part and a space inside the abrasive part, so as to bond the cap and the abrasive part.

The present invention further provides a grinding disk which includes an abrasive part and a cap disposed on the abrasive part. The cap and the abrasive part are bonded by injecting a molding material into a space between the cap and the abrasive part and a space inside the abrasive part.

DETAILED DESCRIPTION

Figure 2:
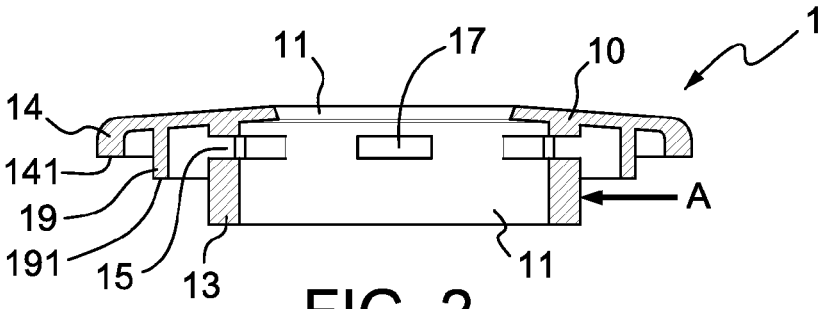
FIG. 2 is a sectional view taken along line 2-2 in FIG. 1.
Figure 1:
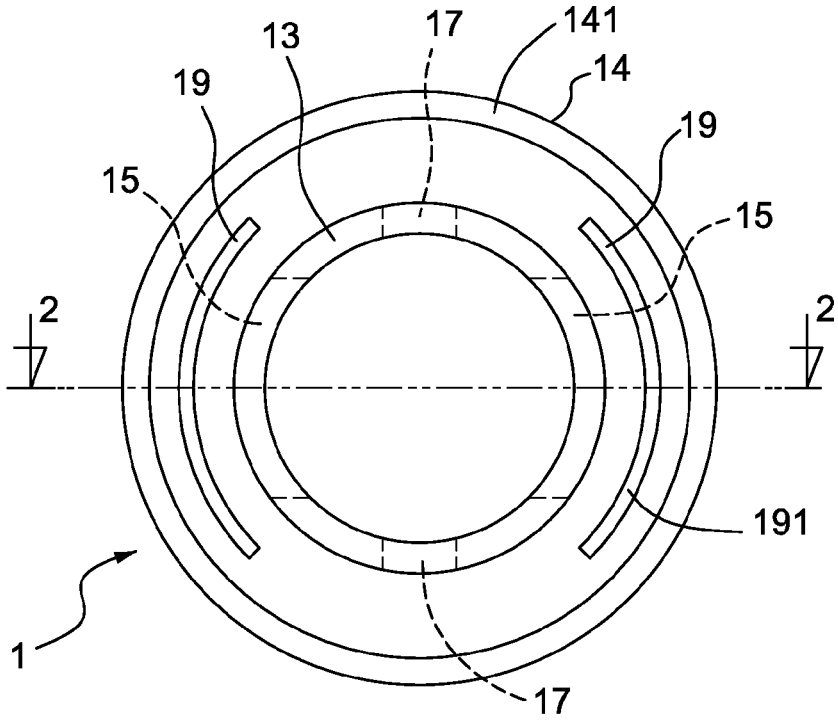
FIG. 1 is a bottom view of a cap according to an embodiment of the present invention.

As shown in FIGS. 1 and 2, a method of making a grinding disk according to a preferred embodiment of the present invention is provided. First, a cap 1 is provided. The cap 1 has a substantially disk-shaped cap body 10 with a through hole 11. An encircled wall 13 and an outer circumferential edge 14 extend downward from a bottom of the cap body 10. The encircled wall 13 surrounds the through hole 11. The encircled wall 13 is formed with a first pair of diametrically opposite slots 15, 15 and a second pair of diametrically opposite slots 17, 17. The second pair of opposite slots 17, 17 and the first pair of opposite slots 15, 15 are approximately disposed in an orthogonal mode. In this embodiment, the length of the first pair of opposite slots 15, 15 is greater than that of the second pair of opposite slots 17, 17. The outer circumferential edge 14 has a bottom side 141.

As shown in FIG. 1, the cap 1 further includes two guide walls 19, 19. The two guide walls 19, 19 extend from the bottom of the cap body 10 along two outer sides of the first pair of opposite slots 15, 15, respectively. Each guide wall 19 has a bottom side 191. The bottom sides 191, 191 of the two guide walls 19, 19 are at least flush with the bottom side 141 of the outer circumferential edge 14. As shown in FIG. 2, in this embodiment, the bottom sides 191, 191 of the two guide walls 19, 19 extend to exceed the bottom side 141 of the outer circumferential edge 14.

As shown in FIG. 2, in this embodiment, the cap 1 is formed integrally by injecting a molding material at a location indicated by arrow A through injection molding. However, the cap 1 may also be formed by other methods and/or using other materials.

Next, an abrasive part 3 is provided. The abrasive part 3 is substantially disk-shaped and has a central hole 31 and a top surface 33. In this embodiment, the abrasive part 31 is made of non-woven fabrics. However, the abrasive part 31 may also be made of other materials such as paper, cloth, or fiber.

Figure 3:
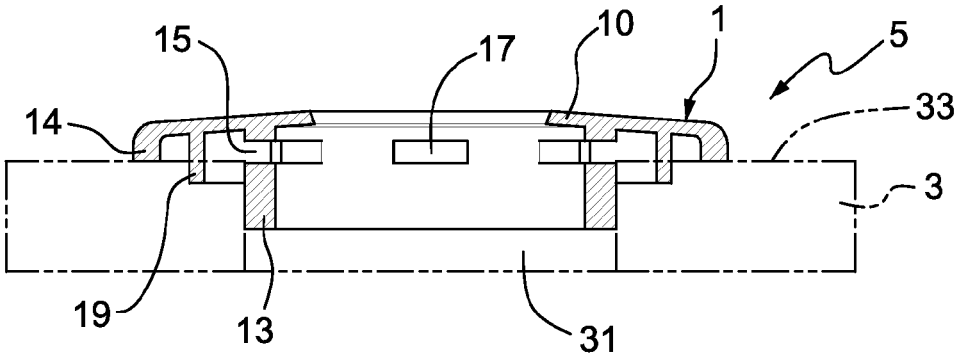
FIG. 3 is a sectional view wherein the cap in FIG. 1 is placed on an abrasive part.

Subsequently, the encircled wall 13 of the cap 1 is inserted in the central hole 31 of the abrasive part 3. At this time, the bottom side 141 of the outer circumferential edge 14 at the bottom of the cap 1 contacts the top surface 33 of the abrasive part 3. The bottom sides 191, 191 of the two guide walls 19, 19 at least contact the top surface 33 of the abrasive part 3. As shown in FIG. 3, in this embodiment, the bottom sides 191, 191 are directly pressed into the abrasive part 3. Therefore, the cap 1 and the abrasive part 3 form an assembly 5.

Figure 4:
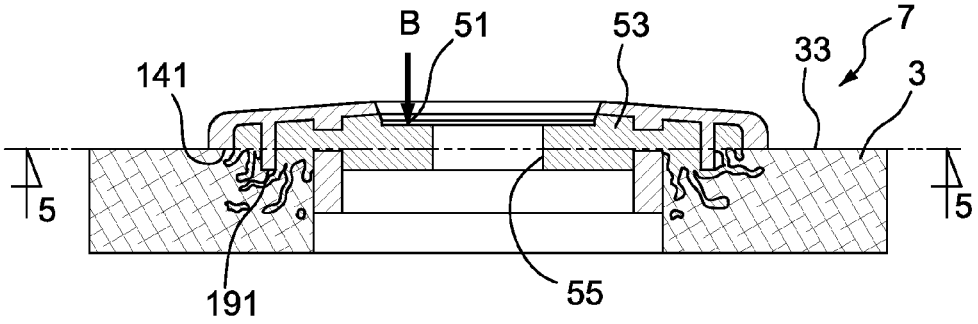
FIG. 4 is a sectional view wherein a molding material is injected into a space between the cap and the abrasive part and a space inside the abrasive part.
Figure 5:
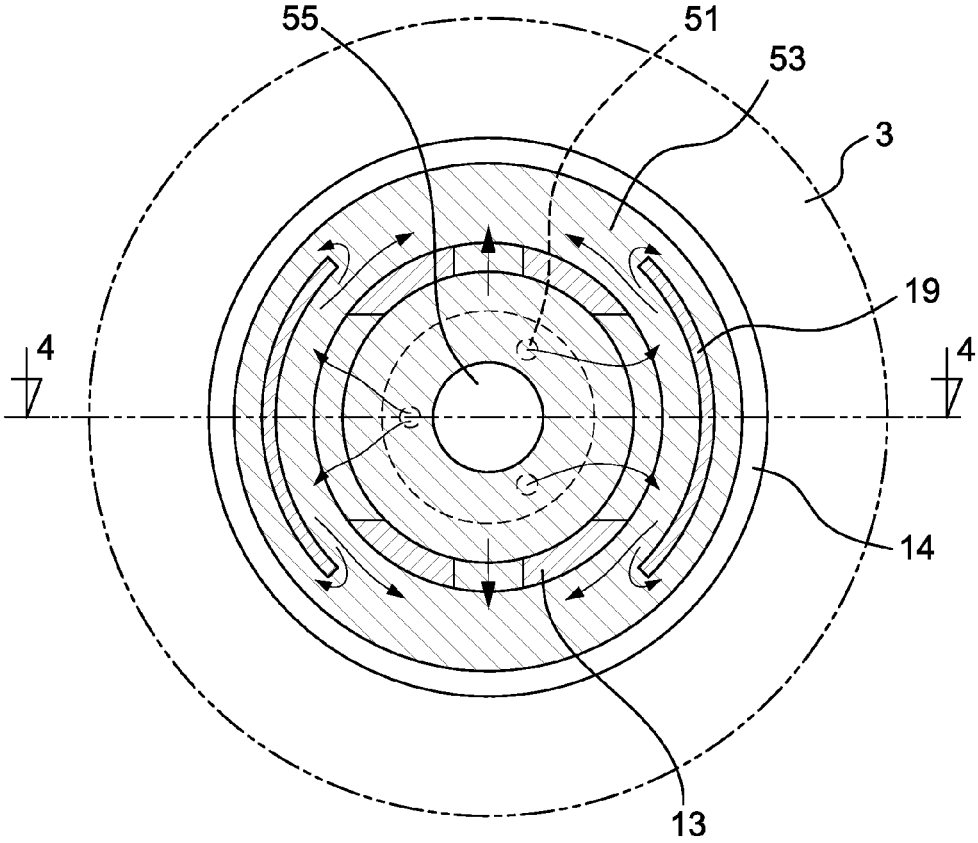
FIG. 5 is a schematic view wherein a molding material flows at a bottom of the cap.

As shown in FIG. 4, the assembly 5 is placed in a mold (not shown), and then a molding material is injected in a direction marked by arrow B. As shown in FIG. 5, in this embodiment, a total of three injection holes 51 is provided.

The molding material is used for holding the cap 1 and the abrasive part 3. As an abrasive part 3 containing cured molding material cannot serve to grind a work piece, the flowing direction of the molding material has to be controlled, so as to prevent the molding material from flowing to outside areas of the abrasive part 3, thereby shortening the service life of the abrasive part 3. As shown in FIG. 4, in this embodiment, due to the design of the mold, the injected molding material is first filled into a space between the cap 1 and the abrasive part 3 and subsequently flows through the first pair of opposite slots 15, 15 and the second pair of opposite slots 17, 17. Due to the outer circumferential edge 14 of the cap 1, the bottom side 141 of the outer circumferential edge 14 contacts the top surface 31 of the abrasive part 3, so that the molding material cannot flow out of the cap 1, and can only be permeated into the abrasive part 3. In addition, the length of the first pair of opposite slots 15, 15 is greater than that of the second pair of opposite slots 17, 17. Therefore, in order to prevent excessive flow of molding material through the first pair of opposite slots 15, 15 and thus uneven distribution of the molding material, the guide walls 19, 19 at outer sides of the first pair of opposite slots 15, 15 at least contact the top surface 33 of the abrasive part 3 through the bottom sides 191, 191, so that the molding material can only flow along the guide walls 19, 19. Thus, the molding material flowing through the first pair of opposite slots 15, 15 is guided to flow towards the second pair of opposite slots 17, 17. Therefore, the molding material can be evenly distributed inside specific areas of the abrasive part 3.

As shown in FIG. 4, after the injected molding material is cured, the cap 1 and the abrasive part 3 are bonded, so as to form a grinding disk 7. In this grinding disk 7, the molding material forms a holding part 53 between the cap 1 and the abrasive part 3. The holding part 53 has a shaft hole 55, which is used to secure the grinding disk 7 on a shaft of the polishing/grinding tool.

The method of the present invention is fast and simple and the produced grinding disk does not break easily during high speed rotation (of 15,000 rpm or more), and has evenly distributed weight so that vibration of the grinding disk during rotation is decreased.

Figure 7:
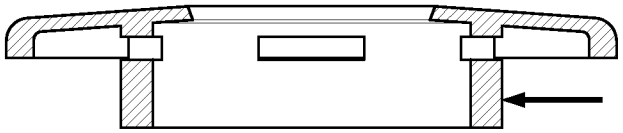
FIG. 7 is a sectional view taken along line 7-7 in FIG. 6.
Figure 6:
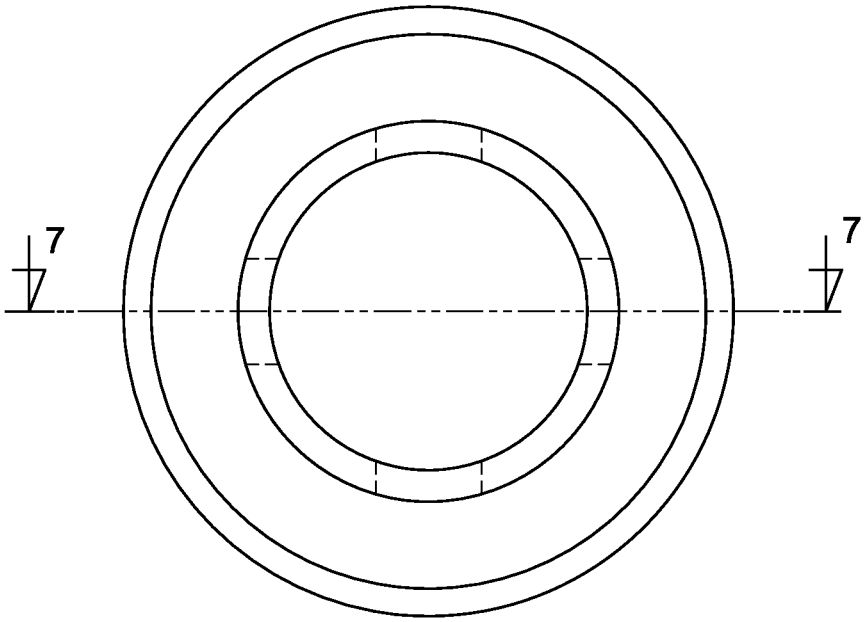
FIG. 6 is a bottom view of a cap according to another embodiment of the present invention.

The preferred embodiments of the present invention have been discussed above. However, the present invention also has alternative designs. For example, the shaft hole 55 may be threaded, so that the shaft hole 55 is provided for the grinding disk 7 to be screwed into the shaft with matching threads of the polishing/grinding tool. In addition, the length of each first opposite slot may be the same as that of each second opposite slot, as shown in FIGS. 6 and 7. Therefore, whether to dispose guide walls is determined according to the actual demands.

While technical solutions and technical features of the present invention are disclosed above, persons skilled in the art can still make replacements and modifications on the basis of the teaching and disclosure of the present invention without departing from the spirit of the present invention. Therefore, the scope of the present invention should not be limited to the disclosure about the embodiments and should cover various replacements and modifications without departing from the present invention as defined in the claims.

LIST OF REFERENCE NUMERALS

1 Cap
3 Abrasive part
5 Assembly
7 Grinding disk
10 Cap body
11 Through hole
13 Encircled wall
14 Outer circumferential edge
15 First pair of opposite slots
17 Second pair of opposite slots
19 Guide wall
31 Central hole
33 Top surface
51 Injection hole
53 Holding part
55 Shaft hole
141 Bottom side of outer circumferential edge
191 Bottom side of guide wall
A Arrow
B Arrow

What is claimed is:

1. A method of making a grinding disk, comprising the steps of:
providing a cap;
providing an abrasive part;
placing the cap on the abrasive part to form an assembly;
holding the assembly and injecting a molding material into a space between the cap and the abrasive part and into the abrasive part to bond the cap and the abrasive part.

2. The method of claim 1, wherein the cap is made by injection molding.

3. The method of claim 1, wherein the abrasive part is made of non-woven materials.

4. The method of claim 1, wherein the abrasive part is substantially disk-shaped and has a central hole, and wherein the cap has a substantially disk-shaped body with a through hole, and an encircled wall extending from the bottom of the cap body and surrounding the through hole, the encircled wall having a first pair of opposite slots so that when the cap is placed on the abrasive part, the encircled wall fits the central hole of the abrasive part, and the molding material is injected through the through hole and the slots and is distributed over a contact region of the cap and the abrasive part and into the abrasive part to bond the cap and the abrasive part.

5. The method of claim 4, wherein the cap further comprises an outer circumferential edge extending downward and having a bottom side, and two guide walls each extending from the bottom of the cap body along the outside of the respective slot of the first pair of opposite slots and having a bottom side the bottom sides of the two guide walls being at least flush with the bottom side of the outer circumferential edge so that when the cap is placed on the abrasive part, the bottom side of the outer circumferential edge contacts a top surface of the abrasive part, and the bottom sides of the two guide walls at least contact the top surface of the abrasive part.

6. The method of claim 4, wherein the encircled wall further has a second pair of opposite slots for the molding material to pass through.

7. The method of claim 3, wherein, after the step of injecting a molding material to bond the cap and the abrasive part, the molding material forms a holding part between the cap and the abrasive part, said holding part having a shaft hole.

8. The method of claim 7, wherein the shaft hole is threaded.

9. The method of claim 4, wherein, after the step of injecting a molding material to bond the cap and the abrasive part, the molding material forms a holding part between the cap and the abrasive part, said holding part having a shaft hole.

10. The method of claim 9, wherein the shaft hole is threaded.

11. The method of claim 6, wherein the length of the first pair of opposite slots is substantially the same as that of the second pair of opposite slots.

12. A grinding disk made by the method of claim 1.

13. A grinding disk, comprising:

an abrasive part; and a cap provided on the abrasive part;

wherein the abrasive part and the cap are bonded by injecting a molding material into a space between the cap and the abrasive part and into the abrasive part.

14. The grinding disk of claim 13, wherein the cap is made by injection molding.

15. The grinding disk of claim 13, wherein the abrasive part is made of non-woven materials.

16. The grinding disk of claim 13, wherein the abrasive part is substantially disk-shaped and has a central hole, and wherein the cap has a substantially disk-shaped body with a through hole, and an encircled wall extending from the bottom of the cap body and surrounding the through hole, the encircled wall having a first pair of opposite slots, the encircled wall fitting to the central hole of the abrasive part and the molding material being injected through the through hole and the slots and distributed over a contact region of the cap and the abrasive part and into the abrasive part to bond the cap and the abrasive part.

17. The grinding disk of claim 16, wherein the cap further comprises an outer circumferential edge extending downward and having a bottom side, and two guide walls each extending from the bottom of the cap body along the outside of the respective slot of the first pair of opposite slots and having a bottom side, the bottom sides of the two guide walls being at least flush with the bottom side of the outer circumferential edge, the bottom side of the outer circumferential edge contacting a top surface of the abrasive part, and the bottom sides of the two guide walls at least contacting the top surface of the abrasive part.

18. The grinding disk of claim 16, wherein the encircled wall further has a second pair of opposite slots for the molding material to pass through.

19. The grinding disk of claim 15, wherein the molding material forms a holding part between the cap and the abrasive part, said holding part having a shaft hole.

20. The grinding disk of claim 19, wherein the shaft hole is threaded.

21. The grinding disk of claim 16, wherein the molding material forms a holding part between the cap and the abrasive part, said holding part having a shaft hole.

22. The grinding disk of claim 21, wherein the shaft hole is threaded.

23. The grinding disk of claim 18, wherein the length of the first pair of opposite slots is substantially the same as that of the second pair of opposite slots.

* * * * *